US006029639A

United States Patent [19]

Mashiko

[11] Patent Number: 6,029,639

[45] Date of Patent: Feb. 29, 2000

[54] FUEL SUPPLY SYSTEM FOR A WATERCRAFT

[75] Inventor: Tetsuya Mashiko, Shizuoka, Japan

[73] Assignee: Yamaha Hatsudoki Kabushiki Kaisha, Japan

[21] Appl. No.: 09/105,545

[22] Filed: Jun. 26, 1998

[30] Foreign Application Priority Data

Jun. 26, 1997 [JP] Japan ..... 9-170624

[51] Int. Cl.[7] ..... F02M 7/08

[52] U.S. Cl. ..... 123/579; 123/184.46; 261/34.2; 440/88

[58] Field of Search ..... 123/73 A, 184.46, 123/579; 440/88; 261/34.2

[56] References Cited

U.S. PATENT DOCUMENTS

| | | | |
|---|---|---|---|
| 4,108,951 | 8/1978 | Niwa et al. | 261/34 B |
| 4,157,365 | 6/1979 | Inoue et al. | 261/34 B |
| 4,243,000 | 1/1981 | Yamada . | |
| 4,272,459 | 6/1981 | Berger | 261/34 A |
| 4,333,888 | 6/1982 | Onofrio | 261/34 B |
| 4,344,396 | 8/1982 | Yamada . | |
| 4,481,914 | 11/1984 | Ishida | 123/179 G |
| 4,508,189 | 4/1985 | Kato . | |
| 4,671,220 | 6/1987 | Inoue et al. . | |
| 4,683,846 | 8/1987 | Takayasu . | |
| 4,957,664 | 9/1990 | Kohno et al. . | |
| 5,018,503 | 5/1991 | Hoshiba et al. . | |
| 5,060,617 | 10/1991 | Kojima et al. . | |
| 5,240,649 | 8/1993 | Yamada et al. . | |
| 5,489,227 | 2/1996 | Ishida et al. | 440/77 |
| 5,560,345 | 10/1996 | Geyer et al. | 123/516 |
| 5,598,827 | 2/1997 | Kato . | |
| 5,669,358 | 9/1997 | Osakabe . | |

FOREIGN PATENT DOCUMENTS

| | | |
|---|---|---|
| 407077107 | 3/1995 | Japan . |
| 408210188 | 8/1996 | Japan . |

*Primary Examiner*—Willis R. Wolfe
*Assistant Examiner*—Brian J. Hairston
*Attorney, Agent, or Firm*—Knobbe, Martens, Olson & Bear LLP

[57] ABSTRACT

A fuel system is provided with an accelerator pump. The accelerator pump has a single influent port and multiple effluent ports. The single influent port draws fuel from a single charge former into a fuel chamber of the accelerator pump. An operational linkage controls a release of the fuel such that the fuel in the fuel chamber is released into the charge formers during periods of rapid acceleration and like operating conditions. Upon actuation, the accelerator pump discharges an additional amount of fuel into multiple charge formers through the corresponding effluent ports of the accelerator pump. Accordingly, a single accelerator pump can be used with multiple charge formers to reduce to overall size of an assembled engine.

21 Claims, 6 Drawing Sheets

FUEL SUPPLY SYSTEM FOR A WATERCRAFT

BACKGROUND OF THE INVENTION

1. Field of the Invention

The present invention relates to a fuel system for an engine powering a small watercraft. In particular, the invention relates to an accelerator pump of a fuel system for such an engine.

2. Description of Related Art

Personal watercraft generally include a water propulsion device which is powered by an internal combustion engine. These watercraft are generally quite small in size, often limited to use by one to three persons. The engine of the watercraft is positioned within an enclosed engine compartment defined by a hull of the watercraft. Due to the small size of the watercraft, the engine compartment is very small, and thus the engine must be arranged in fairly compact fashion.

When of the two-cycle variety, previous engines generally have fuel delivered to incoming air for combustion via one or more carburetors. The carburetor provides a relatively simple mechanism for providing fuel (i.e. it does not require complex electronic controls which may be associated with a fuel injection system) and is relatively reliable.

In many applications, the use of a carburetor having a single fuel supplying mechanism and throttle valve is sufficient. The sporting nature of use associated with personal watercraft makes it very desirable, however, to selectively add a quantity of fuel over and above the basic fuel supplying mechanism. Specifically, when moving a watercraft from idle to its planing speed, rapid acceleration is often desired. For the engine to provide the necessary acceleration, a great deal of fuel must be supplied to the engine in a relatively short time period. This amount of fuel, however, is much larger than that generally required when the engine is idling or when the engine is running at a relatively steady high speed, such as after the watercraft has planed.

As such, the carburetor may be provided with a fuel increasing mechanism or "accelerator pump" arranged to increase fuel supply in certain situations. Often, this mechanism includes a fuel chamber in which a cache of fuel is stored until the necessary delivery time. A problem exists that this fuel cache is often a fuel chamber which is located at the engine and which is subject to the very high heat generated by the engine and trapped in the small engine compartment. The exposure of the fuel cache to these high temperatures contributes to evaporation of the fuel. Since the time between periods of engine acceleration may be quite long, when the need for the supply of extra fuel finally arises, the fuel chamber may be empty or at least depleted.

Other embodiments of accelerator pumps arrange the pump inside the carburetors themselves. This structure often complicates the structure of the carburetor and increases the size of the overall assembled engine. The increased size of the assembled engine is due to the need for each carburetor to have an individual fuel cache.

Thus, a need exists for an improved accelerator pump arrangement for an engine powering a personal watercraft.

SUMMARY OF THE INVENTION

Accordingly, one aspect of the present invention involves a small watercraft having a hull. The hull defines an engine compartment in which an engine is positioned. A longitudinally extended straddle-type seat is arranged, at least partially, in an elevated position relative to the engine compartment. The engine has a plurality of charge formers and an air intake system. The air intake system routes air to the plurality of charge formers. The engine also has a main fuel supply mechanism which supplies a first amount of fuel to the charge formers. In addition, the engine has a single fuel increasing mechanism which communicates with at least two of the charge formers so that the fuel increasing mechanism can selectively supply a second amount of fuel to the at least two charge formers in addition to the first amount of fuel provided by the main fuel supply mechanism.

Another aspect of the present invention involves an engine for a small watercraft. The engine comprises at least two floatless-type carburetors. The carburetors each have a central passage with a throttle valve positioned therein. The engine also has a main fuel supply mechanism for supplying a primary amount of fuel to the carburetors. An accelerator pump is also provided which has a single influent port and at least two effluent ports. Each of the effluent ports is individually connected to a corresponding carburetor. The influent port is connected to a single carburetor. The accelerator pump selectively distributes fuel through the effluent ports to each of the carburetors to provide an additional amount of fuel to the carburetors. The engine also has an actuating mechanism for controlling the accelerator pump.

A further aspect of the present invention also involves an engine for a small watercraft. The engine comprises at least two floatless-type carburetors. The carburetors each have a central passage with a throttle valve positioned therein. The engine also has a main fuel supply mechanism for supplying a primary amount of fuel to the carburetors. The engine also has a fuel supply means for supplying an additional amount of fuel to the carburetors. The fuel supply means is controlled by an actuating means such that the additional amount of fuel can be supplied on demand.

BRIEF DESCRIPTION OF THE DRAWINGS

These and other features, aspects and advantages of the invention will now be described with reference to the drawings of a preferred embodiment which is intended to illustrate and not to limit the invention, and in which.

DETAILED DESCRIPTION OF THE PREFERRED EMBODIMENT OF THE INVENTION

Figure 1:
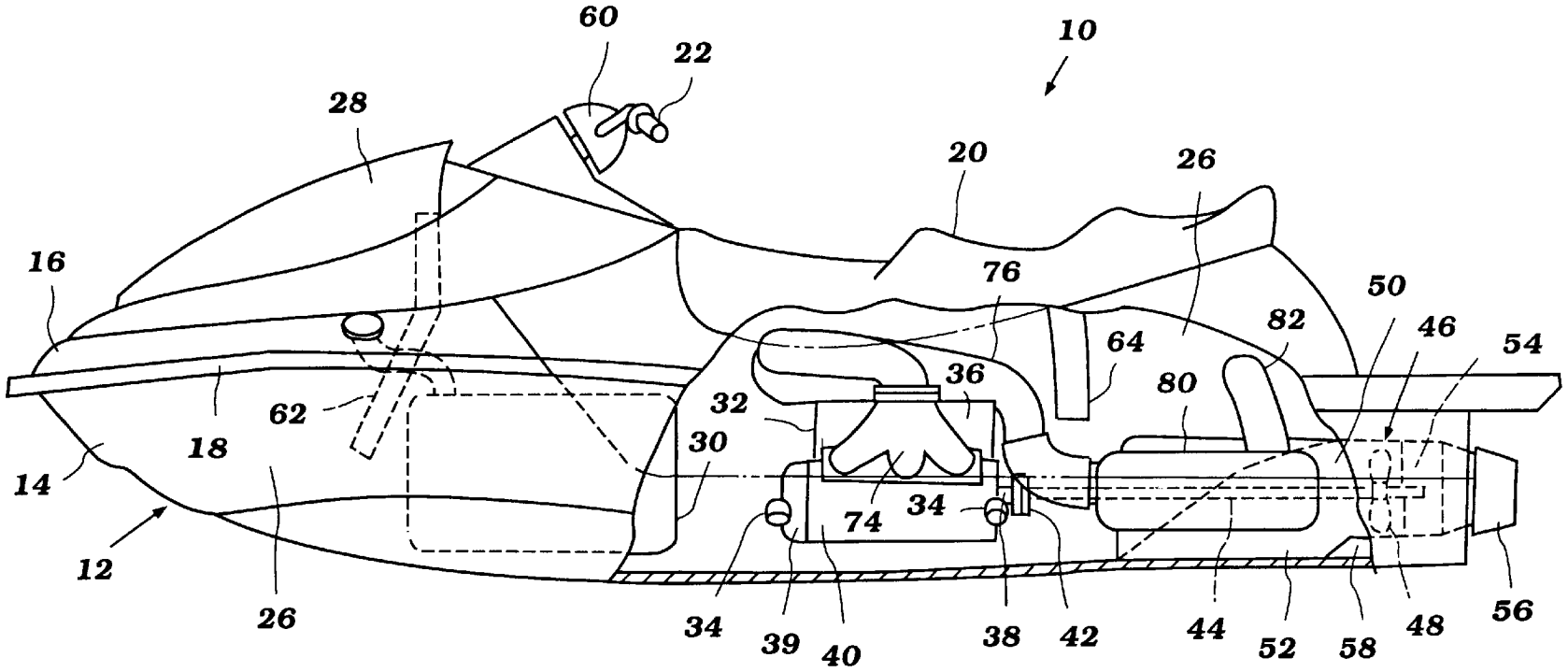
FIG. 1 is a broken-out section of a side elevational view of a personal watercraft including an engine and fuel supply system configured in accordance with a preferred embodiment of the present invention.

With reference to FIG. 1, a personal watercraft 10 is illustrated which includes a fuel supply system configured and arranged in accordance with a preferred embodiment of the present invention. Although the present fuel supply system is illustrated in connection with a personal watercraft, the fuel supply system can be used with various engines used with other types of watercraft and vehicles as well, such as, for example, but without limitation, small jet boats, and the like.

Before describing the present fuel supply system, the exemplary personal watercraft 10 will first be generally described to assist the reader's understanding of the environment of use and the operation of the illustrated fuel supply system. In addition, in order to assist the reader's understanding of the following description, an orthogonal coordinate system is defined as follows: a "lateral" axis generally extends side to side; a "longitudinal" axis generally extends between the bow and stem and lies perpendicular to the lateral axis; and a vertical axis lies perpendicular to both the longitudinal and lateral axis. Moreover, "fore" will refer to a generally forward direction and "aft" will refer to a generally rearward direction. Further, in the figures, an intake airflow will be indicated by an "A" while an air-fuel mixture will be indicated by an "A/F".

As illustrated in FIG. 1, the watercraft 10 includes a hull 12 formed by a lower hull section 14 and an upper deck section 16. The hull sections 14, 16 are formed from a suitable material such as, for example, a molded fiberglass reinforced resin. The lower hull section 14 and the upper deck section 16 are fixed to one another about their peripheral edges to form a gunwale, 18 in any suitable manner.

A passenger seat 20 is provided proximate to a stern of the hull as shown in FIG. 1. The passenger seat 20 is mounted in a longitudinal manner substantially about a longitudinal center plane of the watercraft 10. In the illustrated embodiment, the seat 20 has a longitudinally extended straddle-type shape which may be straddled at least by an operator. In addition, in some applications, the seat 20 can accommodate one or two passengers who are comfortably seated behind the operator. The seat 20 also desirably includes a removable seat cushion to increase the comfort of the operator and the passengers.

A forward end of the seat 20 lies proximate to controls 22 of the watercraft 10 which generally lie at or about the longitudinal center plane of the watercraft 10. The configuration of the seat 20 and the controls 22 desirably position the operator on the watercraft 10 is a position which provides the watercraft 10 with fore and aft balance when the operator rides alone.

The hull 12 of the personal watercraft 10 defines a forward compartment 24 and a rear compartment 26 as shown in FIG. 1. An access hatch 28 can cover an access opening leading into the forward compartment 24 while the seat 20 can cover an access opening leading into the rear compartment 26. In the exemplary watercraft depicted in FIG. 1, a fuel tank 30 and a buoyant block (not illustrated) are arranged within the forward compartment 24. The buoyant block affords additional buoyancy to the watercraft 10.

As further depicted in FIG. 1, an engine 32 is contained within the rear compartment 26 and is mounted primarily beneath the forward portion of the seat 20. Engine mounts 34 secure the engine 32 to the hull lower portion 14 in a known manner. The engine 32 is desirably mounted in approximately a central position on the watercraft 10. As will be recognized by those of skill in the art, the engine can also be mounted in other locations within the hull of the watercraft.

The engine 32 powers the illustrated personal watercraft 10. The engine 32 is comprised of a cylinder block and cylinder head assembly 36, an output shaft or crankshaft 38, and a crankcase assembly 40. The crankcase assembly 40 is affixed to the cylinder block 36 in a known manner. In the illustrated embodiment, the crankshaft 38 extends in a substantially longitudinal direction and is journaled for rotation within the crankcase assembly 40. The crankshaft 38 provides an output of rotational power drawn from the engine 32 in a known manner. As will be recognized by those of skill in the art, the crankshaft 32 can be the output or can be coupled to a separate output shaft.

With reference to FIG. 1, a coupling 42 flexibly couples the engine crankshaft 38 to an impeller shaft 44. The impeller shaft 44 extends rearward through a bulkhead (not shown), and a protective sleeve (not shown), to a jet propulsion unit 46. The impeller shaft 44 transfers the rotational power of the crankshaft to an impeller 48 of the jet propulsion unit 46. A bearing assembly (not shown), which is secured to the bulkhead (not shown), supports the impeller shaft 44 behind the shaft coupling 42.

The jet propulsion unit 46 is positioned in a tunnel 50 in a rear center region of the lower hull section 14 located behind the bulkhead (not shown). The tunnel 50 includes a gullet 52 having an inlet opening formed on the bottom side of the lower hull section 14. A ride plate 58 covers a portion of the tunnel 50 behind the inlet of the gullet 52 to enclose the propulsion unit 46 within the tunnel 50. In this manner, the lower opening of the tunnel 50 is closed by the front edge of the gullet 52 and the ride plate 58.

The gullet 52 extends from the inlet opening to a pressurization chamber 54 which houses the impeller 48. The impeller 46 is located toward the front end of the pressurization chamber 52. A central support (not shown) supports the rear end of the impeller shaft 40 behind the impeller 46 and generally at the center of the pressurization chamber 52. The pressurization chamber 54 in turn communicates with a nozzle section 56 of the propulsion unit 46. The impeller 46 pressurizes the water within the pressurization chamber 54 and forces the pressurized water through the nozzle section 56 of the jet propulsion unit. The steering nozzle 56 directs the exit direction of the water stream exiting the jet propulsion unit 46. The steering nozzle 56 is pivotally supported at the rear of the jet propulsion unit 46 to change the thrust angle on the watercraft 10 for steering purposes as is known in the art.

The steering nozzle 56 is connected to a control mast 60. The control mast 60 forms part of the operator controls 22 which are mounted in front of the operator seat 20 as noted above. The control mast 60 also can include a throttle control (not shown) for controlling the speed of the engine.

In the illustrated embodiment, the engine 32 includes three in-line cylinders and operates on a two-stroke compression principle. This engine type, however, is merely exemplary. Those skilled in the art will readily appreciate that the illustrated fuel supply system can be used with any of a variety of engine types having other numbers of cylinders, having other cylinder arrangements and operating on other combustion principles (e.g., four-stroke principle).

Figure 2:
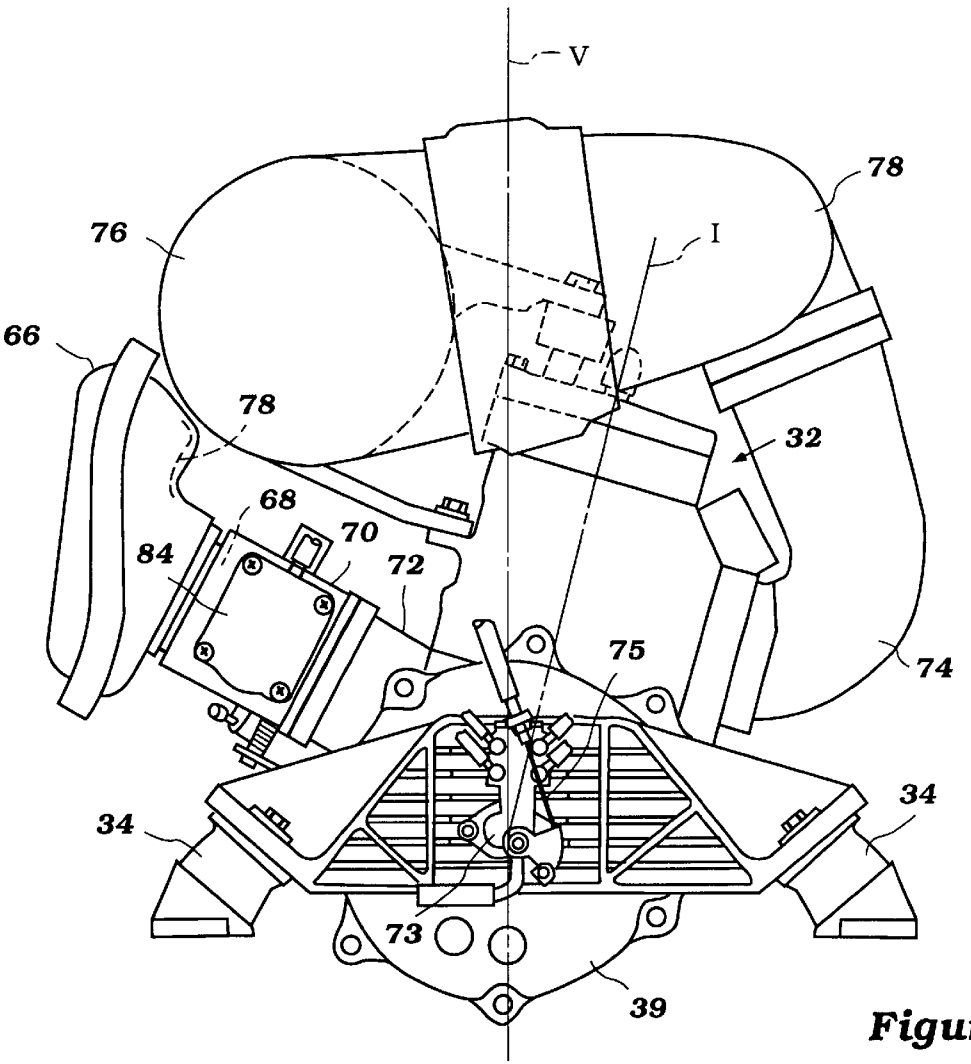
FIG. 2 is a front elevational view of the engine of FIG. 1.

As shown in FIG. 2, the illustrated engine 32 is positioned such that the three cylinders, which are formed in a row in the cylinder block 36, lie inclined to a longitudinally-extending substantially vertical plane, V, of the watercraft 10. The substantially vertical plane extends through the crankshaft. In particular, the center axis, or centerline, of each cylinder is inclined along a longitudinally-extending inclined plane defined by inclined centerlines, I, of each cylinder in the illustrated embodiment. Thus, the illustrated engine 32 is arranged with the crankshaft 38 oriented in a generally longitudinal direction; however, the engine need not be so oriented for use with the illustrated fuel supply system.

The engine 32 includes a plurality of charge formers for providing an air and fuel mixture (A/F) to a combustion chamber (not shown) of each cylinder. As will be recognized by those of skill in the art, the combustion chamber is defined in each cylinder of the illustrated embodiment by the cylinder block and cylinder head assembly 36. In the illustrated embodiment, the charge formers are a set of carburetors 70.

Air inlets 62, 64 are provided in the forward compartment 24 and the rear compartment 26 respectively. The air inlets 62, 64 provide a source of air for an internal engine 32 which powers the personal watercraft 10. Preferably, as shown in FIG. 1, air is drawn into the engine compartment through the inlets in the hull 62, 64. Air is then drawn into an intake system including an intake or air box 66. The air also travels through a passage 68 defined by a body of a carburetor 70 and a passage through an intake manifold 72 leading into the engine 32. The air box 66 is mounted to a first end of the carburetor 70 in a known manner. The end of the carburetor 70 opposite the air box 66 is mounted to the intake manifold 72 also in a known manner. The intake manifold 72, in turn, is connected to the crankcase 40 of the engine 32.

The air and fuel mixture passes through the passage 68 of the carburetor 70 into the engine 32 in a known manner. Specifically, the air and fuel mixture passes through an intake port (not shown) into a crankcase chamber (not shown) defined for each cylinder within the crankcase 40. The air and fuel charge within the crankcase chamber (not shown) is delivered to its respective combustion chamber (not shown) in a manner known by those of skill in the art, such as, for example, but without limitation, scavenge ports. A suitable ignition system (not shown) is provided for igniting the air and fuel mixture provided to each combustion chamber (not shown). Preferably, this system comprises a spark plug (not shown) having its electrode tip positioned in the combustion chamber (not shown). Each spark plug is preferably fired by a suitable ignition control system.

The illustrated engine includes a flywheel magneto assembly 39 connected to one end of the crankshaft 38. While the illustrated embodiment of FIG. I shows the flywheel magneto assembly 39 arranged proximate a forward end of the engine, the flywheel magneto assembly 39 can also be arranged proximate a rear end of the engine. The flywheel magneto assembly 39 desirably has a number of magnets located thereon for use in a pulsar-coil arrangement for generating firing signals for the ignition control system. In addition, the ignition control system may include a battery (not shown) for use in providing power to an electric starter and other electrical engine features. Moreover, a number of teeth may be mounted on the periphery to form a ring gear of the flywheel magneto assembly 39 for use in starting the engine with a starter motor.

The illustrated engine also includes a lubricating system (not shown) for providing lubricating oil to the various moving parts thereof. Preferably, the lubricating system includes an oil tank or reservoir (not shown) from which lubricating oil is delivered to and circulated throughout the engine, as is well known to those of skill in the art. An oil pump 73 can be arranged on the forward side wall of the crankcase 40 as illustrated in FIG. 2. The oil pump 73 may be further provided with a control actuator (not shown) which acts through a Bowden wire 75 in a manner well known to those of skill in the art.

With reference to FIG. 1, exhaust gases produced by the internal combustion engine 32 are passed out of the engine through an exhaust system to a point external to the personal watercraft 10. The exhaust system has an exhaust manifold 74 comprised of a plurality of runners which are in communication with each of the cylinders in the cylinder block 36 of the internal combustion engine 32. The runners combine the exhaust gases from each cylinder at the manifold 74 and transfer the expelled exhaust gases from the engine 32 to the balance of the exhaust system. Specifically, the manifold 74 communicates with an expansion chamber 76 into which the exhaust gases are transferred through a first exhaust pipe 78. From the expansion chamber 76, the exhaust gases pass through a water lock 80 and into a second exhaust pipe 82. The exhaust is then released into the pressurization chamber 54 of the watercraft 10, or other similar area, and desirably is released into the water passing through the pressurization chamber 54. Because the exhaust system is considered conventional, further description of the exhaust system is deemed unnecessary.

Moreover, a cooling system is desirably provided for cooling the engine. Such cooling systems are well known to those of skill in the art and, as such, the cooling system of the illustrated engine 32 is not described in detail herein. The cooling system typically routes liquid coolant to one or more coolant jackets (not shown) associated with the engine 32. A water temperature sensor (not shown) may be provided for measuring the coolant temperature in use within the cooling system.

The watercraft and engine described above are considered to be conventional and provide an exemplary environment of use for the illustrated embodiment of the present fuel supply system and accelerator pump. The illustrated fuel supply system and accelerator pump will now be described with reference to FIGS. 2–6. In general, the illustrated carburetor 70 is of the floatless variety and includes an accelerator pump 114 for providing an additional amount of fuel to the engine over and above that provided by a main fuel delivery system. The carburetor can also be a float-fill type of carburetor; however, it is desirable to use a floatless carburetor in the environment of a personal watercraft. Because of the sporting nature of the personal watercraft, a float-fill type of carburetor can have difficulty maintaining proper fuel levels in the fuel chambers for efficient operation. In contrast, as described below, a floatless carburetor, due to the relatively constant level of fuel maintained within a fuel bowl by either a constant flow of fuel into the carburetor or a controlled-metered supply of fuel can effectively maintain the requisite fuel level required for efficient operation of the engine 32.

As explained above, fuel is provided to each cylinder for combustion via the carburetor 70. Preferably, fuel is combined with the incoming air passing through the passage 68 of the carburetor 70. This introduction of fuel is accomplished by a main fuel supply mechanism. In the illustrated embodiment, fuel is drawn from the fuel tank 30 (see FIG. 1) positioned in the forward compartment 24 by a fuel pump 90 and delivered through a fuel delivery line (not shown) to a charge former, which in this case comprises the carburetor 70. Fuel which is delivered to the carburetor 70 but not delivered to the air flowing therethrough may be returned to the fuel tank 30 through a return line (not shown).

In the illustrated embodiment, a throttle valve 93 and a choke valve 92 are movably supported in the passage 68 through the carburetor 70 for allowing the watercraft operator to control the rate of air flow past a fuel-delivering venturi 91 of the engine 32. As will be recognized by one of skill in the art, a choke valve need not be arranged within the passage 68 of the carburetor 70. In other words, a choke valve may either be eliminated from the system or may be arranged within the system at a location outside of the passage 68 through the carburetor 70. The operator can control the speed and power output of the engine 32 via a throttle linkage 94. A choke linkage 96 is also provided. Preferably, the throttle linkage 94 is moveable with the assistance of a throttle control actuator (not shown) positioned on the control mast 60 of the watercraft.

Figure 3:
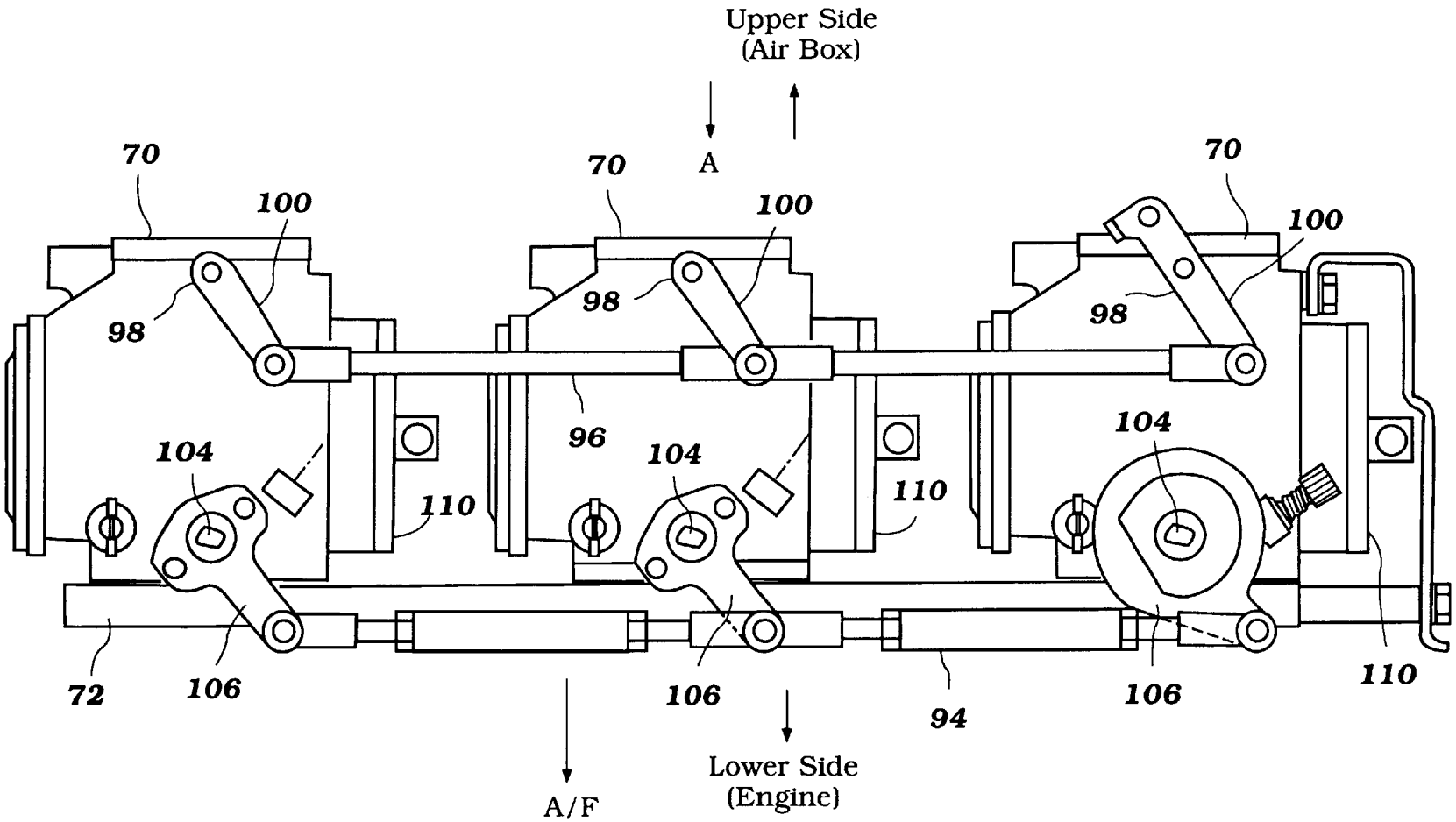
FIG. 3 is side elevational view of a carburetor assembly of the engine of FIG. 1 viewed from a side of the carburetor assembly opposite a cylinder block of the engine.

With reference principally to FIG. 3, the choke valve 92 comprises a disc (see FIG. 5) which is supported by a choke shaft 98. This shaft 98 is mounted for rotation with respect to the body of the carburetor 70. A first end of a choke lever 100 is connected to an end of the choke shaft 98 which extends beyond the outside of the carburetor 70. A second end of the lever 100 is rotatably connected to the choke linkage 96 by a pin 102. Though not shown, the choke valve 92 is moved by a cable or similar control which is actuated by the control at the control mast 60.

Figure 4:
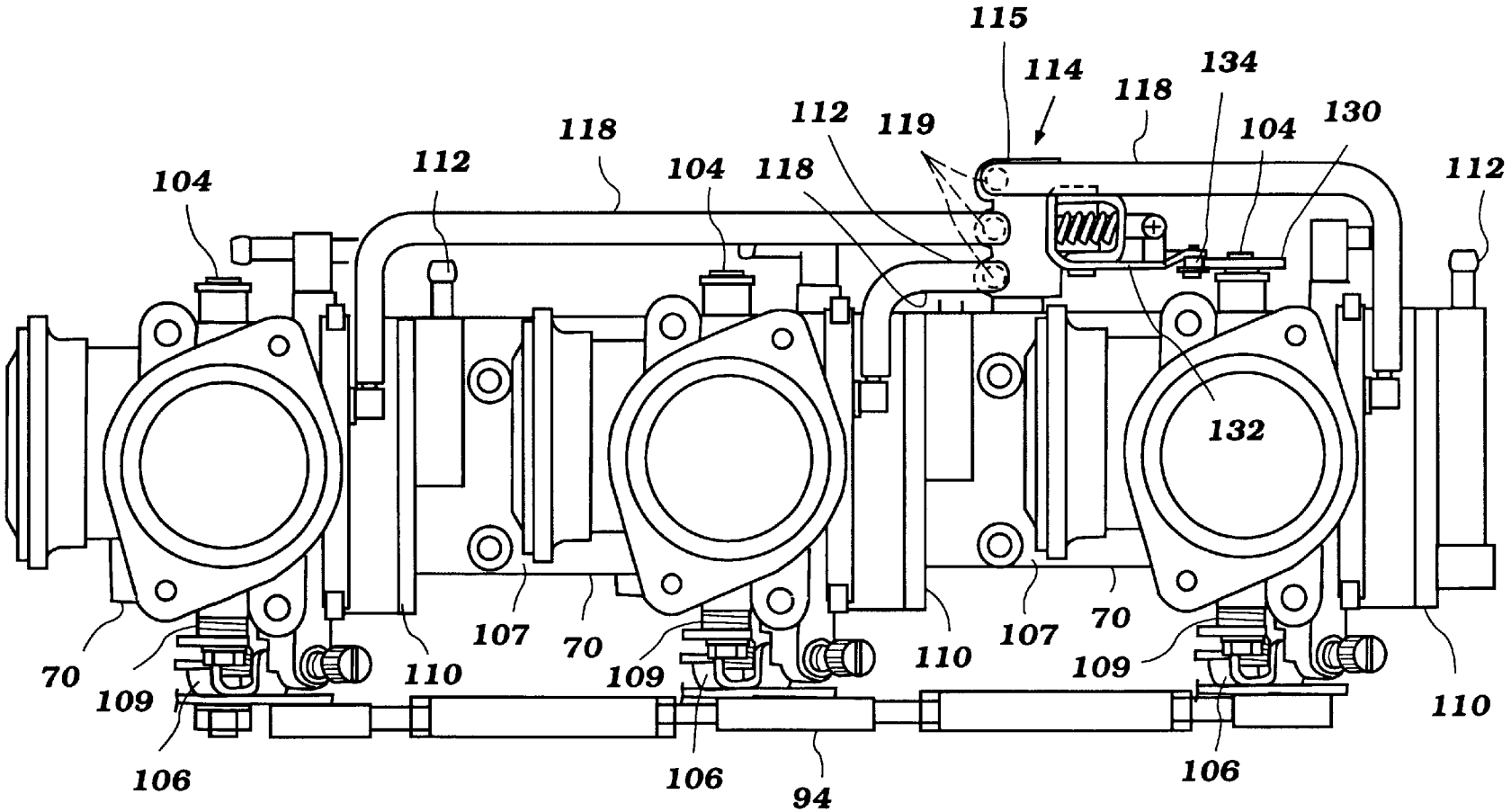
FIG. 4 is top plan view of FIG. 3.

Similarly, the throttle valve 93 comprises a disc (not shown) which is mounted to a throttle shaft 104. This throttle shaft 104 is mounted for rotation with respect to the body of the carburetor 70. A first end of a throttle lever 106 is connected to an end of the shaft 104 which extends beyond the body of the carburetor 70. A second end of the lever 106 is rotatably connected to the throttle linkage 94 of an operating mechanism via a pin 108. The throttle lever 106 is actuated remotely from the throttle grip or control at the control mast through a cable (not shown). As illustrated in FIG. 4, the throttle shaft 104 is provided with a torsion spring or other suitable biasing element 109 such that the throttle plate is returned to an idle orientation when the actuator is released by the operator.

In the instant arrangement, a separate intake, and thus carburetor 70, is provided corresponding to each of the cylinders of the engine 32. Thus, the throttle linkage 94 and choke linkage 96 each extend to a corresponding throttle lever 106 and choke lever 100 of the carburetor 70 for each of the other cylinders. As illustrated in FIG. 3, the individual carburetors 70 are coupled together to a single intake manifold 72. Moreover, the individual carburetors 70 can also be coupled together using a series of coupler plates interposed between individual carburetors (see FIG. 4). The linkages 94, 96 for the throttle valves and choke valves also couple the respective levers 106, 100. In this fashion, rotation of the throttle lever 106 with the cable effectuates rotation of the lever 106 associated with the other carburetors via the linkage 94. As is well known to those of skill in the art, a variety of other throttle and choke operating mechanism arrangements may also be provided.

Fuel which is delivered to the carburetor is pressurized and delivered into the air stream through the passage with a fuel pump 110 (this pump may be additional to, or the same pump as, the above-referenced pump 90 which may be used to deliver fuel from the fuel tank to the carburetor). With reference to FIGS. 3–6, fuel is delivered through the supply line (not shown) to the pump 110. The pump 110 is preferably of the diaphragm operated or actuated type and forms a portion of each carburetor 70. As such, the pump 110 has a fuel chamber (not shown) on one side of a diaphragm (not shown) and an air chamber (not shown) on the opposite side of the diaphragm. Air pressure pulses are provided to the air chamber through a tube (not shown) which is connected to a pressure inlet nipple 112 (see FIG. 4). The tube may extend from the crankcase 40 or the like so as to transfer a pressure pulse adequate to operate the diaphragm pump 110.

A fuel increasing mechanism, or accelerator fuel supply system, is associated with the carburetor set 70 for providing an additional amount of fuel beyond that ultimately provided from each individual fuel pump 110 to the venturi 91 arranged within the passage 68. The additional amount of fuel increases engine responsiveness when the operator wishes to rapidly accelerate the speed of the engine and the associated output speed. Preferably, this mechanism includes a fuel supply mechanism and an actuator for actuating the fuel supply mechanism. The supply mechanism comprises a single accelerator pump 114 and the actuator comprises an operational linkage. The accelerator pump 114 is adapted to transfer a limited amount of fuel to each of the three carburetors 70 of the illustrated embodiment. In particular, the necessary supply of fuel is drawn through a supply line 116 (see FIG. 6) from a single carburetor 70 and expelled through a plurality of discharge lines 118 into each of the carburetors 70 of the engine 32.

Figure 5:
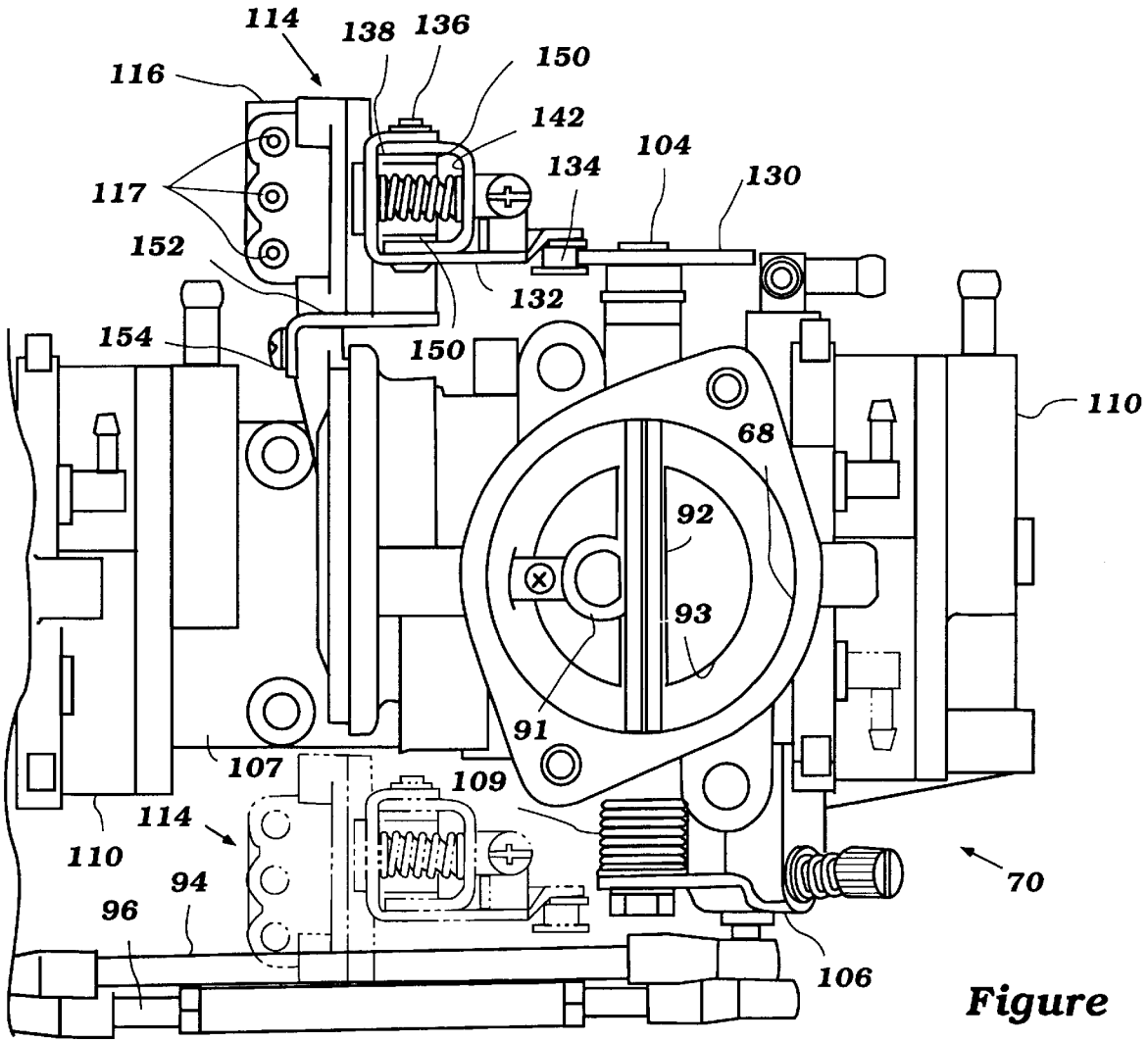
FIG. 5 is an enlarged, partial top plan view of FIG. 3.

As will be appreciated by those of skill in the art, the illustrated embodiment of the accelerator fuel supply system, best shown in FIGS. 4 and 5, utilizes a diaphragm pump for the accelerator pump 114. Accordingly, an accelerator fuel supply chamber (not shown) is defined within the accelerator pump 114, in part by a pump housing 115. A diaphragm member (not shown) separates this chamber (not shown) from a piston chamber (not shown). The fuel supply chamber is also advantageously interposed between a plurality of one-way check valves and associated influent or effluent ports 117, 119. One of the check valves, which is associated with the influent port 117, only allows a flow of fuel into the fuel supply chamber and the balance of the check valves, which are associated with the effluent ports 119, only allow a flow of fuel out of the fuel supply chamber.

While the illustrated embodiment utilizes a diaphragm pump, other pumps can also be utilized with the illustrated fuel supply system. For instance, but without limitation, a piston pump can be utilized. The piston pump has a piston with a plunger which cooperates with a housing to pump the fuel. As the piston and the attached plunger are raised, a vacuum is created below the plunger due to a seal which is arranged between the plunger and the housing walls. Because of the vacuum, and similar check valves to those described above, fuel is pulled into the piston pump. The down stroke of the piston forces the fuel out of the effluent ports and evacuates a portion of the piston pump as is well known in the art.

Figure 6:
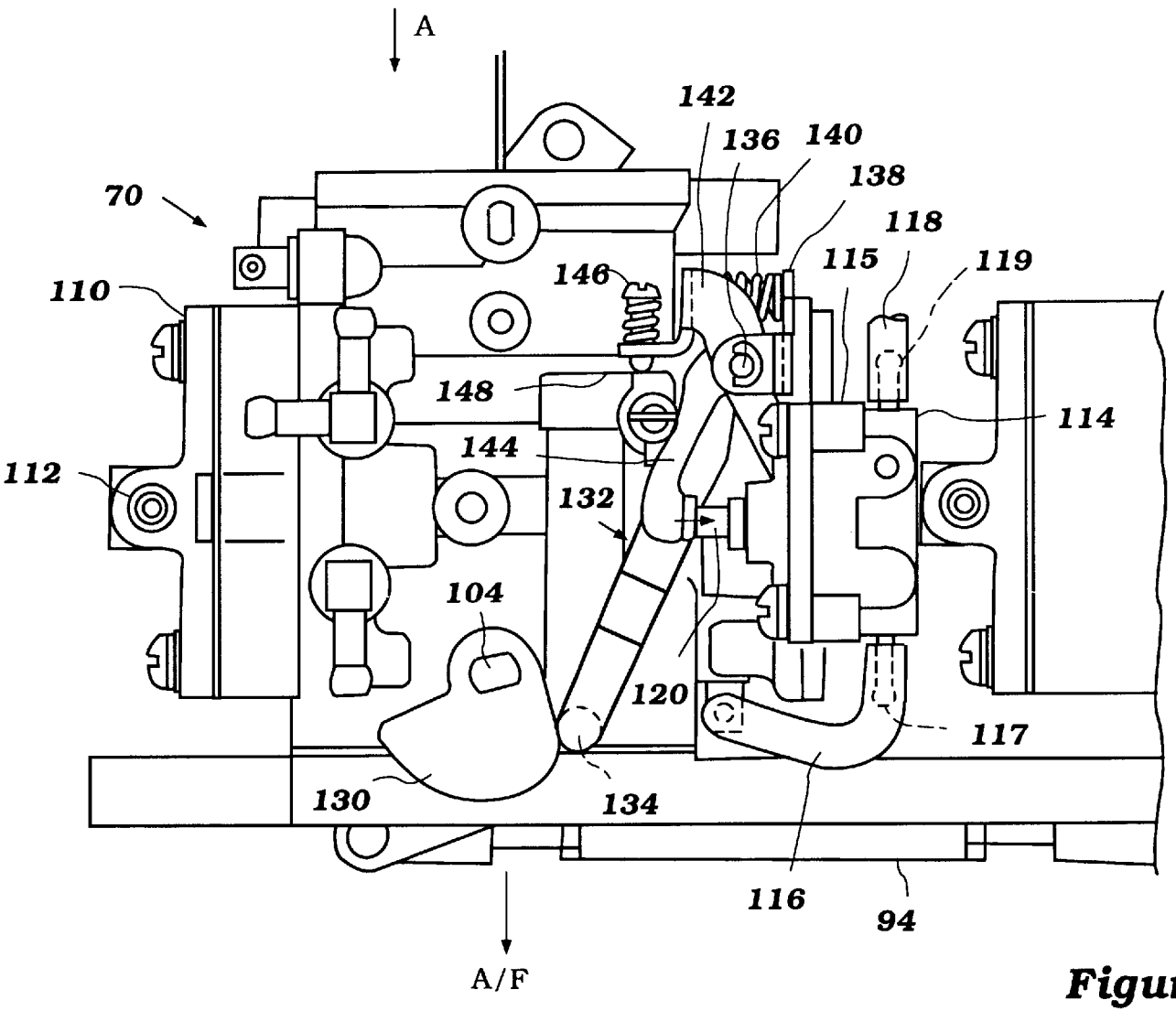
FIG. 6 is a side elevational view of the carburetor assembly of the engine of FIG. 1 viewed from an opposite side of the carburetor assembly from FIG. 3.

The accelerator pump 114 also includes a piston 120 which is biased in a raised position by a spring (not shown). The piston is movable in an axial direction along a passage (not shown) through a sleeve (not shown) which extends from the pump housing 115. When the piston moves inwardly, it displaces the diaphragm downward into the fuel supply chamber. The displacement of the diaphragm, in cooperation with the one-way check valves, urges fuel out of the fuel supply chamber into the discharge lines 118. When the piston returns outwardly under the force of the biasing spring, the diaphragm is pulled upwardly and the accelerator pump 114 draws fuel into the supply chamber through the supply line 116 and the single one-way check valve 117. As illustrated in FIG. 6, fuel is drawn through the supply passage from the fuel chamber of the carburetor 70; however, as will be recognized by those of skill in the art, other configurations can also be utilized. Moreover, although the illustrated embodiment of the accelerator pump 114 obtains its fuel supply from an end carburetor, any of the other carburetors can also be the source. It should be noted that the accelerator pump 114 is desirably arranged, at least in part, between two adjacent carburetors 70.

The plurality of fuel discharge lines 118 lead from the fuel supply chamber to the passage 68 through each of their associated carburetors 70. In the illustrated embodiment, best shown in FIGS. 4 and 6, the accelerator pump has three discharge lines 118 each routed to the corresponding three carburetors 70. In the illustrated embodiment, the discharge lines 118 terminate downstream of the throttle valve thereby allowing the selective introduction of an additional amount of fuel into the air stream below the throttle valve. The discharge lines 118 can also terminate upstream of the throttle valve.

The operational linkage by which the accelerator pump 114 is operated will be described with reference primarily to FIGS. 5 and 6. As best illustrated in FIG. 6, a cam mechanism is provided which comprises a cam surface 130 attached to the throttle valve shaft 104, and a follower element 132 which abuts the cam surface 130. In the illustrated embodiment, the accelerator pump 114 and the cam mechanism are arranged on the opposite side of the carburetor 70 from the control linkages 94, 96. However, as illustrated in phantom, they can also be arranged on the same side as the linkages 94, 96 in a position between the carburetor 70 and the linkages 94,96 or outside of the linkages 94, 96.

As described above, the illustrated cam 130 is mounted to the end of the throttle valve shaft 104. The follower element 132 is in contact with the cam surface 130. Specifically, a roller 134 of the follower element 132 is in contact with the cam surface 130 to ease the transition and reduce the wear between the translating travel of the follower element 132 and the rotational action of the cam 130. Desirably, the cam 130 is shaped to provide a rapid initial displacement of the follower element 132 when the throttle valve shaft 104 is rotated as opposed to a slow displacement throughout the range of motion of the throttle valve shaft 104. The follower 132, as illustrated in FIG. 5, extends at an angle past a pivot point defined by a pin 136 and defines a lower support surface 138 for a biasing member such as a compression spring 140.

The biasing member 140 is fixed in a location between the lower support surface 138 and an upper action surface 142. In the illustrated embodiment, the upper action surface 142 is an extension of an actuator arm 144. As such, the biasing member 140, in cooperation with the follower element 132 and the actuator arm 144, form a lost motion coupling so as to enable each of the coupled members of the carburetor and accelerator pump to complete their full ranges of individual motion. In other words, the lost motion coupling couples the follower element 132 and the actuator arm 144 to allow movement of one while the other is periodically stationary.

The actuator arm 144 also has an adjustable stop 146 which comprises a threaded fastener and a spring. The spring acts to resist movement of the threaded fastener once the stop 146 is adjusted to an optimal position. The adjustable stop 146 is arranged to contact a surface 148 of either the pump housing or the carburetor body to limit the travel of the actuator arm 144 in a known manner. By limiting the travel of the actuator arm 144, the stroke length of the piston 120 can be adjusted with the use of the stop 146.

As illustrated in FIGS. 5 and 6, the actuator arm 144 and the follower element 132 share a common pivot axis defined by the pin 136. The pin 136 is also coupled to a pair of lugs 150 (see FIG. 5) formed on a mounting bracket 152. A bolt 154 secures the pin-coupled mounting bracket 152, the follower element 132 and the actuator arm 144 to the body of the carburetor 70. The mounting bracket 152 can also secure the follower element 132 and the actuator arm 144 to the housing 115 of the accelerator pump 114.

In use, the cam 130 rotates with the throttle valve shaft 104. The cam 130 displaces a first end of the follower element 132 having the roller 134. The displacement of the first end of the follower element 132 displaces the second end of the follower element due to the intermediate pivot axis defined by the pin 136. The second end, or lower support surface 138, of the follower element 132 is thereby urged against the biasing force of the compression spring 140. The compression spring 140 initially transfers the force to a first end, or upper action surface 142, of the actuator arm 144. The first end is displaced by this force and, consequently, the second end of the actuator arm 144 is displaced due to, once again, the intermediate pivot axis defined by the pin 136. The displacement of the second end results in a force which is applied to the piston 120 of the accelerator pump 114. The force on the piston 120 of the accelerator pump 114 results in a displacement of the piston 120 and an actuation of the accelerator pump 114. Thus, a finite amount of fuel is injected through the check valves 117 and the associated discharge lines 118 into the individual carburetors 70.

As discussed above, the stroke length of the piston 120 can be modified by adjusting the stop 146 in or out. Once an end of the stop 146 has contacted a stopping boss, or other surface 148, the movement of the actuator arm 144 ceases and the compression spring 140 is compressed by further movement of the follower element 132. Thus, the throttle valve shaft 104 and cam 130 can continue to move even when the actuator arm 144 and the stroke of the piston 120 of the accelerator pump 114 has ended. Once the throttle valve shaft 104 begins to return the associated throttle valve (not shown) to a closed position, the compression spring 140 acts to return the operational linkage to its initial or idling position.

Because of the unique configuration of the illustrated accelerator pump 114, a single accelerator pump 114 can be utilized with a plurality of carburetors 70. The single accelerator pump 114 communicates with each intake passage 68 of the plurality of carburetors 70 at a location which is desirably downstream of the throttle valve (not shown). Thus, a single injection of supplemental fuel can be supplied to each carburetor during brief periods of rapid acceleration or starting or other similar operating conditions. The single injection of fuel thereby advantageously boosts performance characteristics of the engine when desired.

In addition, even though the fuel supply for the accelerator pump 114 is a single carburetor 70, because of the use of the accelerator pump 114 in combination with a floatless type of carburetor 70, the accelerator pump 114 does not significantly affect the performance of the source carburetor 70. In other words, because a floatless carburetor 70 provides a relatively constant fuel level in the fuel supply chamber of the carburetor 70 through a special valving arrangement known to those of skill in the art, the drawing off of an amount of fuel for use with the accelerator pump 114 does not significantly impact the performance of the donating carburetor 70.

Moreover, the illustrated accelerator pump 114 is advantageously arranged between the flywheel magneto (not shown) and the coupling 42 of the crankshaft 38 to the impeller shaft 44. This location subjects the accelerator pump 114 to less vibration. Specifically, in the illustrated embodiment, vibrations are typically of larger amplitude at either end of the crankshaft 38 due to the heavy mass of the flywheel magneto arranged on one end of the crankshaft and the equally heavy mass of the coupling arranged on the other end. Vibrations can greatly affect the performance and life of most mechanical equipment, including the accelerator pump 114. Thus, the accelerator pump 114 is desirably arranged in a location which reduces the severity of the vibrations associated with the crankshaft 38.

As described above, the accelerator pump 114 can be located on either side of the carburetors 70. More specifically, the accelerator pump 114 can be located between the carburetors 70 and the engine block 36 or on the side of the carburetors 70 opposite the engine block 36 (as illustrated in phantom in FIG. 5). In addition, the accelerator pump 114 can be arranged on an opposite side of the carburetors from the substantially vertical plane, V. Desirably, the accelerator pump 114 is arranged on the side of the carburetors 70 opposite the engine block 36 to reduce the heat absorbed by the fuel prior to injection by the accelerator pump 114 into the carburetor 70. The increased temperature can result in vaporization of the fuel at high temperatures, thereby affecting engine performance. In addition, the accelerator pump 114 is arranged, at least in part, between two adjacent carburetors. This positioning of the illustrated embodiment results in a more compact construction for the overall engine assembly and reduces the ultimate distance between the accelerator pump 114 and the most removed carburetor 70.

Although this invention has been described in terms of a certain embodiment, other embodiments apparent to those of ordinary skill in the art also are within the scope of this invention. Thus, various changes and modifications may be made without departing from the spirit and scope of the invention. Accordingly, the scope of the invention is intended to be defined only by the claims that follow.

What is claimed is:

1. A small watercraft comprising a hull defining an engine compartment, a longitudinally extended straddle-type seat arranged at least partially above the engine compartment, an engine positioned within the engine compartment, the engine having a plurality of floatless charge formers, an air intake system for routing air to the plurality of charge formers, a main fuel supply mechanism for supplying a first amount of fuel to the charge formers, and a single fuel increasing mechanism, the fuel increasing mechanism drawing fuel from a supply reservoir of one charge former and communicating with at least two charge formers so that the fuel increasing mechanism can selectively supply a second amount of fuel to the at least two charge formers in addition to the first amount of fuel provided by the main fuel supply mechanism.

2. The watercraft of claim 1 further comprising a plurality of cylinders, each of the cylinders having a centerline therethrough which is inclined relative to a vertical plane defined through a crankshaft.

3. The watercraft of claim 2, wherein the fuel increasing mechanism is arranged on an opposite side of one of the plurality of charge formers from the vertical plane.

4. The watercraft of claim 1, wherein the fuel increasing mechanism is arranged at least in part between two adjacent charge formers.

5. The watercraft of claim 1, wherein the fuel increasing mechanism includes a plurality of output ports, and the number of output ports corresponds to the number of charge formers.

6. The watercraft of claim 5, wherein each of the output ports is connected to each of the charge formers.

7. The watercraft of claim 1 further comprising an output shaft, a flywheel magneto coupled to the output shaft and located proximate a first end of the engine, an impeller shaft, a coupling joining the impeller shaft to the output shaft proximate the second end of the engine, and the fuel increasing mechanism arranged between the flywheel magneto and the flexible coupling.

8. An engine for a small watercraft, the engine comprising at least two floatless-type carburetors, the carburetors each having a central passage with a throttle valve positioned therein and a main fuel supply mechanism for supplying a primary amount of fuel to the carburetors, the main fuel supply mechanism including a supply reservoir, an accelerator pump having a single influent port and at least two effluent ports, the influent port of the accelerator pump connected to the supply reservoir of the main fuel supply mechanism of one of the carburetors, each of the at least two effluent ports individually connected to a corresponding carburetor, the accelerator pump selectively distributing fuel, which is drawn through the influent port from the supply reservoir of one of the carburetors, through the effluent ports to each of the carburetors to provide an additional amount of fuel to the carburetors, and an actuating mechanism connected to the accelerator pump.

9. The engine of claim 8, wherein each carburetor comprises a choke valve positioned in the central passage of the respective carburetor.

10. The engine of claim 9, wherein each effluent port is connected to a corresponding carburetor at a point downstream of the respective throttle valve.

11. The engine of claim 8, wherein the actuating mechanism comprises a cam attached to a throttle valve shaft that supports a throttle valve disc of one of the carburetors.

12. The engine of claim 11, wherein the actuating mechanism further comprises a follower element which abuts the cam, and an actuator arm which is coupled to the follower element through a lost motion coupling, the actuator arm operating the accelerator pump.

13. The engine of claim 12, wherein the lost motion coupling comprises a elastically deformable biasing member interposed between a surface of the follower arm and a surface of the actuator arm.

14. The engine of claim 11, wherein the accelerator pump further comprises a piston having a stroke length, and the actuating mechanism provides a means of adjusting the stroke length of the piston.

15. The engine of claim 8 further comprising a flywheel magneto assembly coupled to a first end of an output shaft, a second end of an output shaft, and the accelerator pump being arranged between the flywheel and the second end of the output shaft.

16. The engine of claim 8 further comprising at least two cylinders, and the accelerator pump being arranged on an opposite side of the carburetors from the at least two cylinders.

17. An engine for a small watercraft, the engine comprising at least two floatless-type carburetors, the carburetors each having a fuel supply chamber and a central passage with a throttle valve positioned therein, a main fuel supply mechanism for supplying a primary amount of fuel to the carburetors, a fuel supply means for supplying an additional amount of fuel to the carburetors, and an actuating means for controlling the fuel supply means such that the additional amount of fuel can be supplied on demand, the fuel supply means drawing fuel from the fuel supply chamber of one of the carburetors.

18. The engine of claim 17 further comprising a throttle valve control linkage.

19. The engine of claim 18, wherein the fuel supply means is arranged on a side of the carburetor opposite of the throttle valve control linkage.

20. The engine of claim 18, wherein the fuel supply means is arranged between a side of the carburetor and the throttle control linkage.

21. The engine of claim 17, wherein the fuel supply means is arranged at least in part between two adjacent carburetors.

* * * * *